United States Patent [19]

Keast

[11] Patent Number: 4,628,792

[45] Date of Patent: Dec. 16, 1986

[54] MODIFIED MUSICAL INSTRUMENT KEYBOARD

[76] Inventor: Lawrence J. Keast, 1500 E. Locust St., Pasadena, Calif. 91106

[21] Appl. No.: 738,034

[22] Filed: May 24, 1985

[51] Int. Cl.[4] ..... G10C 3/12

[52] U.S. Cl. ..... 84/451; 84/423 R

[58] Field of Search ..... 84/423–424, 84/427–428, 451

[56] References Cited

U.S. PATENT DOCUMENTS

| | | | |
|---|---|---|---|
| 1,421,464 | 7/1922 | Hans . | |
| 1,603,676 | 10/1926 | Förster . | |
| 1,775,330 | 9/1930 | Stoehr . | |
| 1,815,228 | 7/1931 | Barth . | |
| 1,851,168 | 5/1932 | Förster . | |
| 1,958,227 | 5/1934 | Barnett . | |
| 2,097,280 | 10/1937 | House . | |
| 2,266,856 | 12/1941 | Farny . | |
| 2,627,777 | 2/1953 | Robbins | 84/423 A |
| 2,706,926 | 4/1955 | Young | 84/451 |
| 3,200,689 | 8/1965 | Rosberger . | |
| 3,915,050 | 10/1975 | Hak . | |

FOREIGN PATENT DOCUMENTS

| | | | |
|---|---|---|---|
| 53177 | 4/1912 | Austria | 84/451 |
| 451142 | 10/1927 | Fed. Rep. of Germany | 84/423 R |

*Primary Examiner*—Lawrence R. Franklin

*Attorney, Agent, or Firm*—Christie, Parker & Hale

[57] ABSTRACT

A keyboard for a musical instrument includes at least one series of keys wherein seven keys in the series and five keys correspond to the typical piano or synthesizer white and black keys, respectively. Twelve narrow keys at a third level raised from the level of the black keys, each coupled to switches for producing a respective pitch and wherein the narrow keys are arranged with respect to the white and black keys such that a narrow key comprises every other key.

7 Claims, 5 Drawing Figures

34
19
26b
26a
26g'
26g
26f'
26f
26e
26d'
26d
26c'
26c
26
28
22
20
20c
20d
20f
20g
20a
10
16
14
14c
14d
14e
14f
14g
14a
14b
12

MODIFIED MUSICAL INSTRUMENT KEYBOARD

BACKGROUND OF THE INVENTION

1. Field of the Invention

The present invention relates to instrument keyboards and more specifically to a modified musical instrument keyboard such as a piano keyboard or synthesizer keyboard.

2. Description of Related Art

Keyboards for keyboard instruments have been known for several centuries and have remained unmodified to a large extent over many years. Several attempts at modifying the typical keyboard, such as for the piano or organ, have been made but have met with limited success. This is due in part to the radical nature of the innovation and to the momentum developed in the use of traditional keyboard arrangements.

House, U.S. Pat. No. 2,097,280, teaches a musical instrument and keyboard for obtaining an increased range of tonality or better musical expression over previous instruments. Each of the six whole tone intervals of an octave is divided into intervals of thirds of a tone, thereby providing a new octavecouple, or 18-interval, scale for the octave instead of the duodecouple scale. This is accomplished by rearranging the piano keyboard to provide a series of white keys, a series of first black keys oriented between each white key, each first black key raised above each white key, and an additional series of second black keys at the same height as each first black key and immediately to the right of each first black key. Each additional black key is positioned immediately before the next adjacent white key. As a result of this arrangement, all keys are assigned a new or different tone than was originally assigned to the respective white and black keys of the original piano. Additionally, the second black keys are placed at a level equal to the level of the first black keys and therefore are difficult to strike without striking an adjacent black key.

Barnett, U.S. Pat. No. 1,958,227, shows a modified piano keyboard wherein two additional keys have been added to the five original black keys to form an unbroken arrangement of black keys.

Other arrangements include the addition of a keyboard entirely separate from the original keyboard with a similar arrangement of keys, similar to a two manual organ. Such arrangements are shown in Stoehr, U.S. Pat. No. 1,775,330, Hak, U.S. Pat. No. 3,915,050, Barth, U.S. Pat. No. 1,815,228, Forster, U.S. Pat. No. 1,603,676, and Hans, U.S. Pat. No. 1,421,464. Another arrangement is shown in Young, U.S. Pat. No. 2,706,926. These arrangements are difficult to use by one trained in playing the traditional keyboard. Rosberger, U.S. Pat. No. 3,200,689, shows another example of such a keyboard. These arrangements are often twice as difficult to manufacture and tune as a result of the doubling of the number of keys on the instrument.

SUMMARY OF THE INVENTION

A keyboard is provided for a musical instrument including at least one series of keys wherein each series comprises seven wide keys at a first level, each coupled to means for providing a sound representing a respective pitch. Five intermediate width keys are provided at a second level raised from the first, each intermediate key coupled to means for producing a sound representing a respective pitch. Each intermediate key is arranged with respect to the wide keys wherein a first intermediate key is positioned between first and second wide keys, a second intermediate key is positioned between the second and a third wide key, a third intermediate key is positioned between a fourth and a fifth wide keys, a fourth intermediate key is positioned between the fifth and a sixth wide keys, and a fifth intermediate key is positioned between the sixth and a seventh wide keys. Twelve narrow keys are provided at a third level raised from the second level, each coupled to means for producing a sound representing a respective pitch. The narrow keys are arranged with respect to the wide and intermediate keys wherein a narrow key comprises every other key.

With this arrangement, the ordinary keyboard is still provided and therefore may be played by those trained in playing the traditional keyboard. The additional keys are coupled to sound producing means such as a touch sensitive switch on a synthesizer tuned for providing a desired pitch. Therefore, the student of the traditional keyboard may supplement the traditional repertoire with notes intermediate of the traditional whole and half-notes or with notes of any selected arrangement. The keyboard is arranged so that the player can strike the narrow keys without interfering with the wide or intermediate keys and without undue effort in reaching the narrow keys.

DETAILED DESCRIPTION OF THE PREFERRED EMBODIMENT

Figure 1:
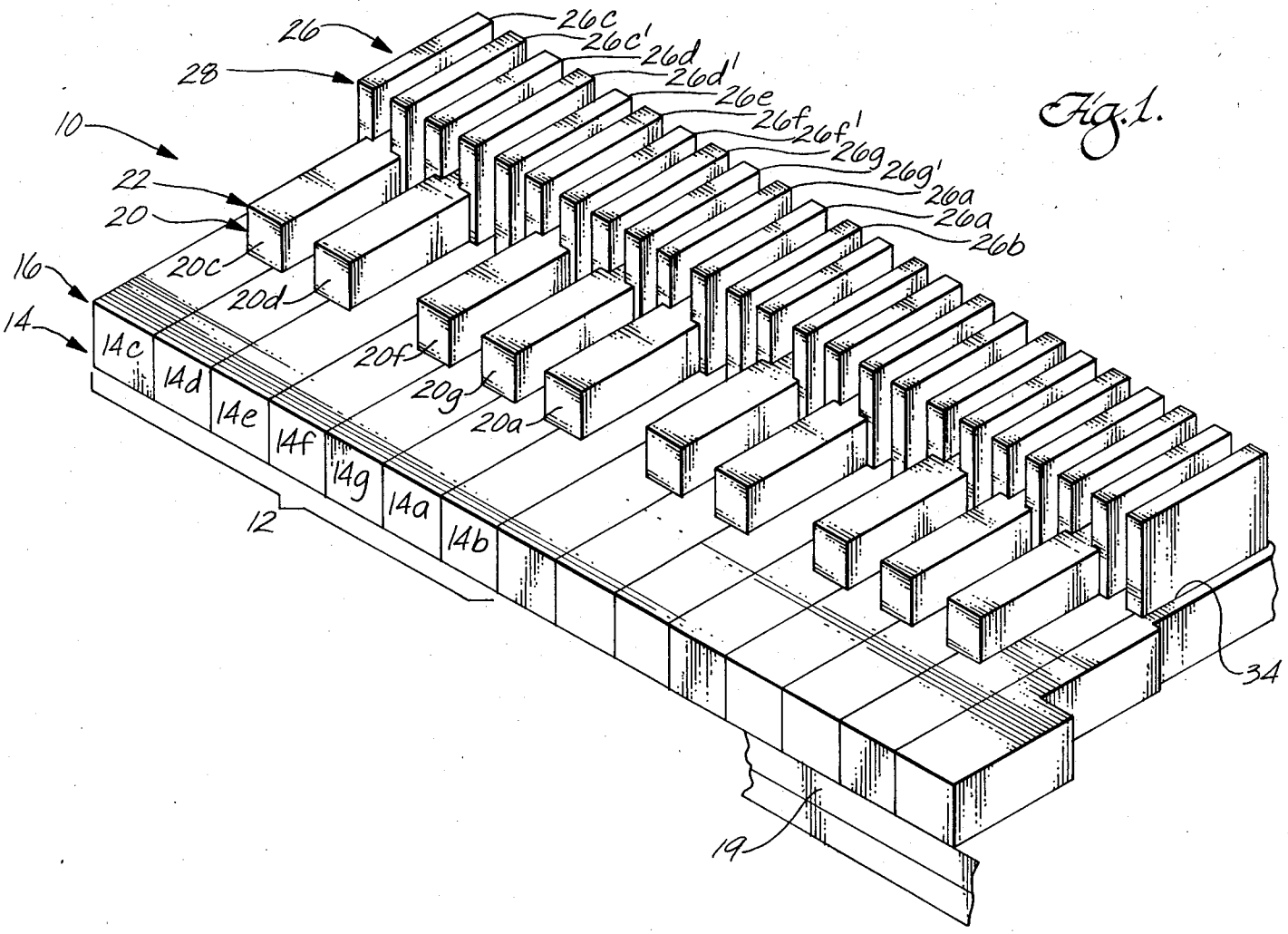
FIG. 1 shows a schematic and perspective isometric view of a portion of a keyboard embodying the present invention including a series of wide keys, a series of intermediate keys at a position raised with respect to the wide keys and a series of narrow keys raised with respect to the intermediate keys.
Figure 2:
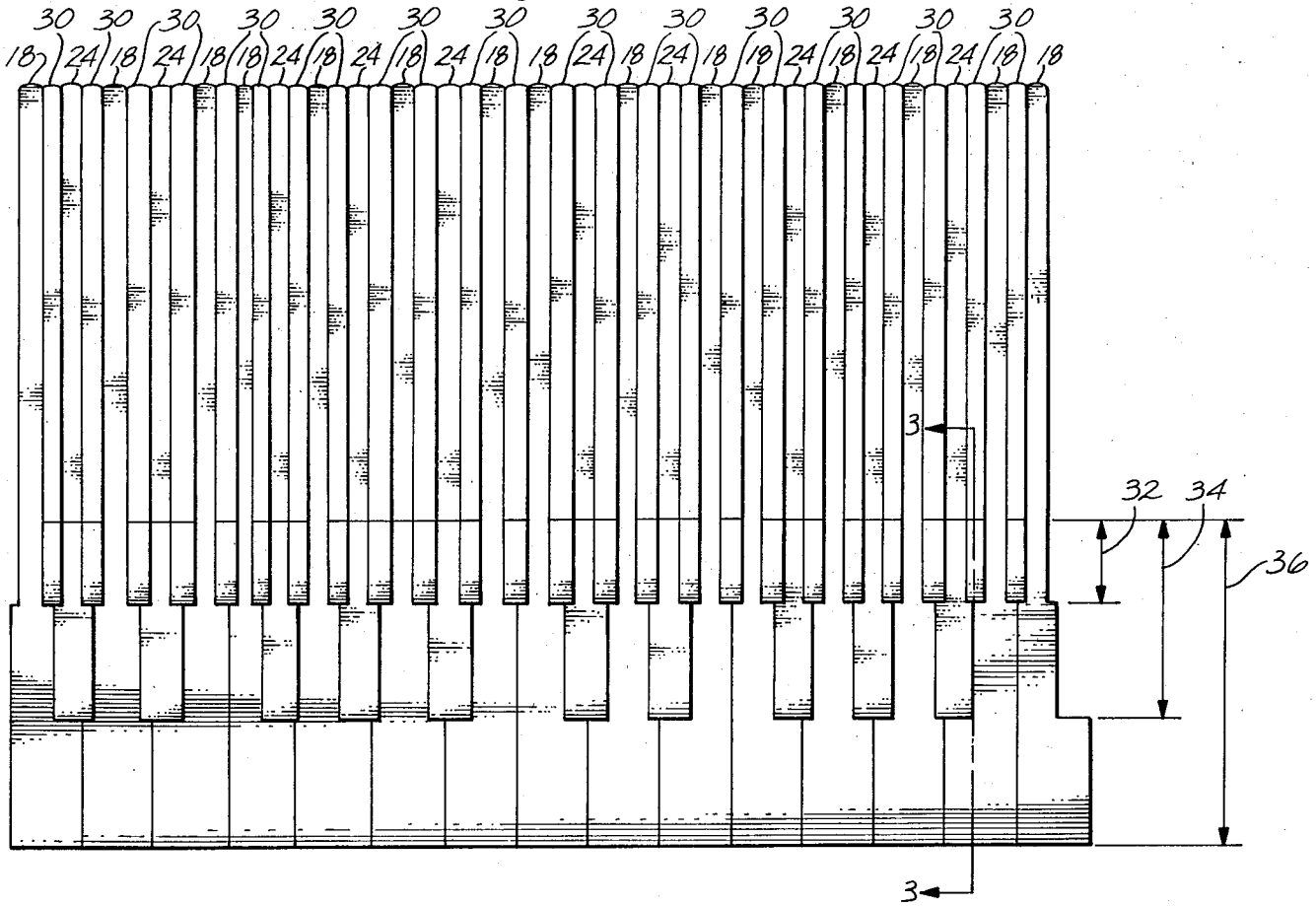
FIG. 2 is a schematic and plan view of the keyboard of FIG. 1.

In FIGS. 1 and 2, a keyboard 10 for a musical instrument is arranged with at least one series 12 of playing keys. The particular instrument to be played with the keyboard may be any number of keyboard instruments such as a piano, organ, synthesizer or accordion. It is to be understood that the keyboard can be configured to the desired instrument for playing.

Each series of keys includes seven wide or white keys 14 at a first level 16, wherein each wide key is coupled to means 18 for producing a sound representing a respective musical pitch. The white keys are equivalent to the seven white keys provided for each octave on present synthesizers. The top surfaces of each white key above the key bed 19 is preferably the same as for typical synthesizers or pianos.

As shown in FIG. 2, each of the seven white keys includes means in the form of a lever in the preferred embodiment for activating a suitable switch to produce the desired pitch. Specifically, a first white key 14c is coupled to a switch through its corresponding lever arm 18 for producing a pitch corresponding to the note C, as is well known in the art. The lever arm 18 may be coupled through a pivot support by a keyboard base (not shown) for allowing movement of the selected key to produce the desired pitch. A second white key 14*d* is similarly coupled through a respective lever arm 18 to a switch for producing a pitch corresponding to the note D. A third white key 14*e* is similarly coupled to a switch for producing a pitch corresponding to the note E. Similar comments can be made with respect to the fourth white key 14*f* corresponding to the note F, the fifth white key 14*g* corresponding to the note G, the sixth white key 14*a* corresponding to the note A, and the seventh white key 14*b* corresponding to the note B.

Five intermediate width keys in the form of black keys 20 are positioned at appropriate locations with respect to the seven white keys in the series of keys. In the preferred embodiment, the black keys correspond to the black keys presently used on typical keyboards such as synthesizer keyboards. The black keys are preferably positioned at a second level 22 raised from the first level such as is typical with present keyboard instruments. Specifically, the second level may be raised $\frac{3}{8}$ inch above the first level to allow depression of the individual black keys for producing a pitch.

As shown in FIG. 2, each of the black keys is coupled to means in the form of lever arms 24 for producing a sound representing a respective pitch. Specifically, a first black key 20*c* is coupled through a respective lever arm 24 to a switch for producing a pitch corresponding to the note C sharp or D flat. The switch is preferably the same type as identified above with respect to the white keys. A second black key 20*d* is coupled through a respective lever arm 24 to a switch for producing a pitch corresponding to the note D sharp or E flat. A third black key 20*f* is coupled through its respective lever arm 24 to a switch for producing a pitch corresponding to the note F sharp or G flat. A fourth black key 20*g* is coupled through a respective lever arm 24 to a switch for producing a pitch corresponding to the note G sharp or A flat. A fifth black key 20*a* is coupled through its respective lever arm 24 to a switch for producing a pitch corresponding to the note A sharp or B flat. The respective lever arms may be coupled to pivots for allowing movement of the keys.

The black keys are arranged with respect to the white keys according to the following arrangement. The first black key 20*c* is positioned between the first and second white keys 14*c* and 14*d*, respectively. The second black key 20*d* is positioned between the second and third white keys 14*d* and 14*e*, respectively. The third black key 20*f* is positioned between the fourth and fifth white keys 14*f* and 14*g*, respectively. The fourth black key 20*g* is positioned between the fifth and sixth white keys 14*g* and 14*a*, respectively. The fifth black key 20*a* is positioned between the sixth and seven white keys 14*a* and 14*b*, respectively.

It is to be understood that additional series of white and black keys are provided each with a like arrangement to extend the width approximate of the particular instrument. For example, for a synthesizer, there will be 88 keys total with the arrangement of black and white keys in each octave as described above. Therefore, a student trained for playing the typical synthesizer or piano keyboard can still play a keyboard as described above without learning any additional fingerings for the repertoire.

In addition to the twelve black and white keys per octave, twelve additional narrow keys 26 are provided as an improvement to the typical keyboard at a third level 28 raised from the second level 22. Preferably, the height of the third level 28 above the second level 22 is the same as the height of the second level 22 above the first level 16. Specifically, the distance between the third level 28 and the second level 22 may be approximately $\frac{3}{8}$ inch. This results, with appropriate arrangements in the key bed for the narrow keys, in a key stroke distance of approximately $\frac{3}{8}$ inch, which would be the same as the key stroke distance for the white keys and for the black keys on the ordinary synthesizer.

Each of the narrow keys 26 are coupled to means in the form of lever arms 30 for producing a sound representing a respective pitch. Specifically, a first narrow or gray key 26*c* is coupled through a respective lever arm 30 to a switch for producing a pitch corresponding to a note, preferably between C and C sharp. In the preferred embodiment, the pitch produced by striking the first gray key 26*c* would be a quarter tone but it is contemplated that other pitch arrangements can be selected other than quarter notes for the gray keys. A second gray key 26*c'* is coupled through a respective lever arm 30 to a switch for producing a pitch corresponding to a quarter note between C and D. A third gray key 26*d* is coupled through a respective lever arm 30 to a switch for producing a pitch corresponding to a quarter note between D and D sharp. A fourth gray key 26*d'* is coupled through a respective lever arm 30 to a switch for producing a pitch corresponding to a quarter note between D sharp and E. A fifth gray key 26*e* is coupled through a respective lever arm 30 to a switch for producing a pitch corresponding to a quarter note between E and F. A sixth gray key 26*f* is similarly coupled to a switch for producing a pitch corresponding to a quarter note between F and F sharp. A seventh gray key 26*f'* is coupled for producing a pitch corresponding to a note between F sharp and G. An eighth gray key 26*g* is similarly coupled for producing a pitch corresponding to a note between G and G sharp. A ninth gray key 26*g'* is similarly coupled for producing a pitch corresponding to a quarter note between G sharp and A. A tenth gray key 26*a* corresponds to a quarter note between A and A sharp, an eleventh gray key 26*a'* corresponds to a quarter note between A sharp and B, and a twelfth gray key 26*b* corresponds to a quarter note between B and C.

As will be described more fully with respect to FIG. 3, the form of the lever arms 18, 24 and 30 will be dictated by the particular instrument on which the keyboard is placed. For a piano, the lever arm will extend from the front of the keyboard a significant distance behind the balance rail pins to a jack and whippen assembly. The lever arm is also weighted to provide the correct feel upon playing. For a synthesizer, the lever arm will be dimensioned according to the particular design. In one configuration, switches are placed immediately below the keys and the lever arms extend beyond guide pins to provide balance for the keys. In another configuration, the lever arms are shortened and springs provide balance for the keys.

It should be understood that the gray keys can be coupled to respective switches tuned to produce tones corresponding to notes other than exact equal tempered quarter notes. By way of example, the gray keys can be coupled to switches which in turn are coupled to means for producing tones other than at equally tempered intervals. With this arrangement, the tone produced by a particular gray key would not be an equal tonal difference between the tones produced by immediately adjacent keys on either side of the gray key. Alternatively, a particular gray key may correspond to a tone outside of the range of tones between those produced by the immediately adjacent keys. This is easily done with a synthesizer.

The gray keys are positioned according to the following arrangement. The first gray key 26 is positioned between the first white and black keys 14*c* and 20*c*, respectively. The second gray key 26*c'* is positioned between the first black key 20*c* and the second white key 14*b*. The third gray key 26*d* is positioned between the second white and black keys 14*b* and 20*b*, respectively. The fourth gray key 26*d'* is positioned between the second black and the third white keys 20*d* and 14*e*, respectively. The fifth gray key 26*e* is positioned between the third and fourth white keys 14*e* and 14*f*, respectively. The sixth gray key 26*f* is positioned between the fourth white and the third black keys 14*f* and 20*f*, respectively. The seventh gray key 26*f'* is positioned between the third black and the fifth white keys 20*f* and 14*g*, respectively. The eighth gray key 26*g* is positioned between the fifth white and the fourth white keys 14*g* and 20*g*, respectively. The ninth gray key 26*g'* is positioned between the fourth black and the sixth white keys 20*g* and 14*a*, respectively. The tenth gray key 26*a* is positioned between the sixth white and fifth black keys 14*a* and 20*a*, respectively. The eleventh gray key 26*a'* is positioned between the fifth black and seventh white keys 20*a* and 14*b*, respectively. The twelfth gray key 26*b* is positioned after the seventh white key 14*b* and immediately before the next succeeding white key corresponding to the note C. Thereafter, the 24 keys of the series are then repeated as desired to obtain the typical synthesizer keyboard with 12 additional gray keys as discussed.

With the arrangement described, a student of the piano or other keyboard instrument using a typical white and black key arrangement can still play the ordinary repertoire using the white and black keys, but with additional training may supplement the repertoire using appropriate gray keys 26 for additional tones. All the keys are still within reach of the player and the first portion of the keyboard is still identical to the ordinary keyboard. The additional means for producing a pitch may be selected or adjusted as desired to provide quarter tones or other tones in addition to those provided by the white and black keys. This arrangement provides for a broader range of sounds over the ordinary keyboard.

The arrangement of the gray keys with respect to the black and white keys of the ordinary keyboard can be seen in FIG. 2. The usable length 32 of the gray key is a fraction of the usable length 34 of the black key, which is similarly a fraction of the usable length 36 of the white keys. However, the length and width of the gray keys 26 are still such that they can be reached conveniently while still playing the white and black keys. Additionally, the width of the gray keys and the spacing between adjacent gray keys are such that a single gray key can be depressed without interfering with an adjacent black key, an adjacent white key or an adjacent gray key. However, each gray key is still wide enough to allow precise striking by the player.

In an exemplary embodiment, the length from the front of the white key to the front of the black key may be approximately two inches, and the length from the front of the black key to the front of the gray key may be approximately two inches. The usable length of the gray key may be between approximately one and one-quarter inches to one and one-half inches. Therefore, the length 32 is approximately one and one-quarter inches, the length 34 is approximately three and one-quarter inches, and the length 36 is approximately five and one-quarter inches. Additionally, the width of the gray key is between three- and four-sixteenths of an inch and the width of the portion of the black key between the front of the gray key and the front of the white key is approximately six- to seven-eighths of an inch. Similarly, the width of the white key beyond the front end of the black key may be approximately seven-eighths of an inch. Without the gray keys, the dimensions of the white and black keys are intended to be standard. With the insertion of the gray keys, portions of each white and black key must be removed to make room for the gray key to be able to move properly. Clearly a certain amount of tolerance is required as is known in the art to allow for movement of the keys with respect to each other. With these dimensions, it has been found that the keyboard may still be conveniently played without the striking of one key interfering with the next by the striking of the adjacent key. However, it is to be understood that these dimensions may be varied just as the dimensions of the standard keyboard vary from one model to another.

As seen in FIG. 2, the first gray key 26*c* is recessed into the right side of the first white key 14*c*. Additionally, the first gray key is recessed into the side of the first black key 20*c* on the left side of the black key. This arrangement still provides for a portion of the first white key to form the lever arm 18 for producing the desired tone and for a portion of the first black key to form the lever arm 24.

The second gray key 26*c'* is recessed into the right side of the first black key 20*c* and into the left side of second white key 14*d*.

A recess is formed in the right side of the second white key 14*d* and a complementary recess is formed in the second black key 20*d* for accepting the third narrow key 26*d*. Complementary recesses are also formed in the right side of the third white key 14*e* and the left side of the fourth white key 14*f* for accommodating the fifth gray key 26*e*. Similar comments can be made with respect to the remaining gray keys arranged with respect to the remaining black and white keys.

Figure 3:
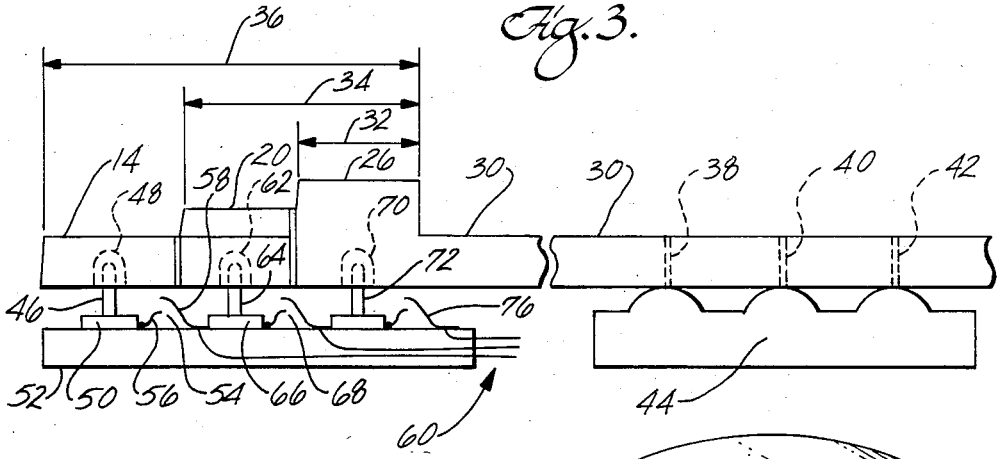
FIG. 3 is a schematic and side section of a portion of the keyboard of FIG. 1 taken along line 3—3 of FIG. 2 and showing the wide, intermediate and narrow keys.

FIG. 3, taken along line 3—3 of FIG. 2, shows a side view of a portion of a modified synthesizer keyboard. The black key 20 is recessed into the left side of white key 14 and the gray key 26 is recessed into the right side of black key 20. The white key extends rearwardly, to the right as shown in FIG. 3, toward the respective lever arm 18. The black key 20 also extends rearwardly to its respective lever arm 24. Similarly, the gray key 26 extends rearwardly to its respective lever arm 30. In the embodiment of FIG. 3, the white, black and gray keys are guided by appropriate guide pins 38, 40 and 42, respectively, according to the typical arrangement on present pianos. This is done in order to provide a keyboard having the same sensitivity and feel as contemporary keyboards. The guide pins are supported on key frame 44.

At the key end of the keyboard arrangement shown in FIG. 3, the black key 14 is supported by the respective guide pin 46 placed within a bushing 48. A pad or punching 50 is placed about the guide pin 46 for cushioning the white key 14. The guide pin 46 and pad 50 are supported on a key frame 52. Mounted on key frame 52 beneath the white key 14 is a switch 54 having a bus side 56 and a ground side 58. The bus side is coupled to a power bus for supplying current or potential to the switch. The ground side 58 is coupled through an appropriate conductor 60 to suitable means for producing a pitch corresponding to a whole note.

In a similar manner, the black key 20 is supported through a bushing 62 on a guide pin 64 supported by the key frame 52. Disposed about the guide pin 64 is a cushion 66. A switch 68, configured in a manner similar to that for switch 54 is located between the black key and key frame 52 for producing a pitch corresponding to a half note. Similarly, the gray key is supported through a bushing 70 on a guide pin 72 mounted on key frame 52. A pad 74 is placed on key frame 52. A third switch 76 configured in a manner similar to switches 54 and 68 is mounted on the key frame beneath gray key 26 for producing a pitch corresponding to the selected note. It is to be understood that each of the remaining white, black and gray keys on the keyboard have a similar structure and configuration with respect to the means for producing pitches. Alternatively, the switches may be relocated to another position according to the particular design of the synthesizer.

Where the modified keyboard arrangement is to be used in conjunction with a piano, the switches are omitted and the guide pin and pad arrangement is substantially as shown in FIG. 3. The lever arms extend past the guide pins 38, 40 and 42 to appropriate jack and whippen assemblies for striking respective sets of strings. Similar modifications may be made to other keyboard instruments for providing a modified keyboard capable of producing additional pitches corresponding to notes other than the usual whole and half notes.

Figure 4:
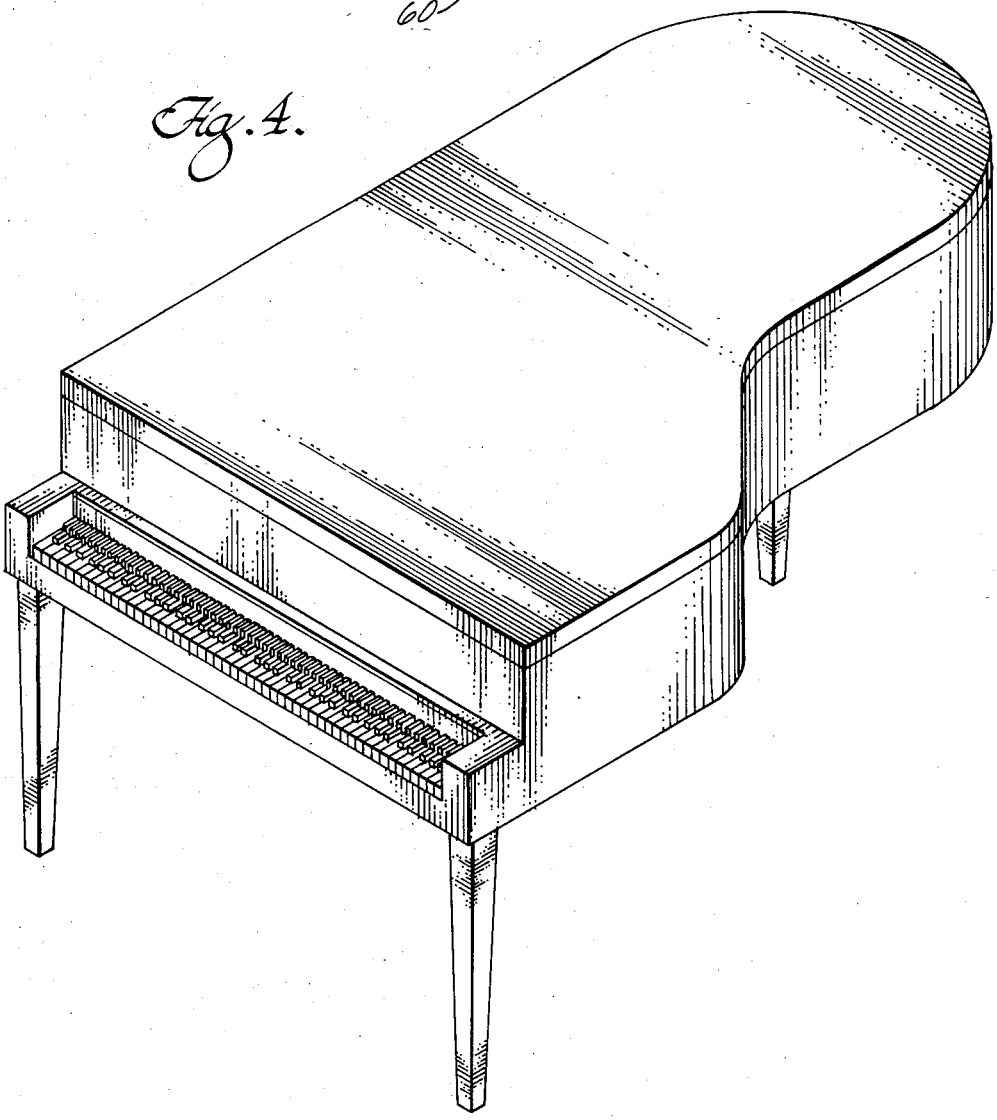
FIG. 4 is a schematic and perspective view of a piano with the keyboard of FIG. 1.

FIG. 4 shows the use of the modified keyboard in conjunction with a piano. The keyboard arrangement is essentially the same as that described with respect to FIGS. 1–3 with appropriate means for coupling the lever arms of the respective keys to the appropriate sets of strings for producing tones. In this configuration, a pianist with his ordinary repertoire would be able to play the usual repertoire without having to learn new fingerings for each arrangement. Or, if the pianist desired to supplement the repertoire with additional pitches, a minimum of effort would be required to add the desired notes to the arrangement.

Figure 5:
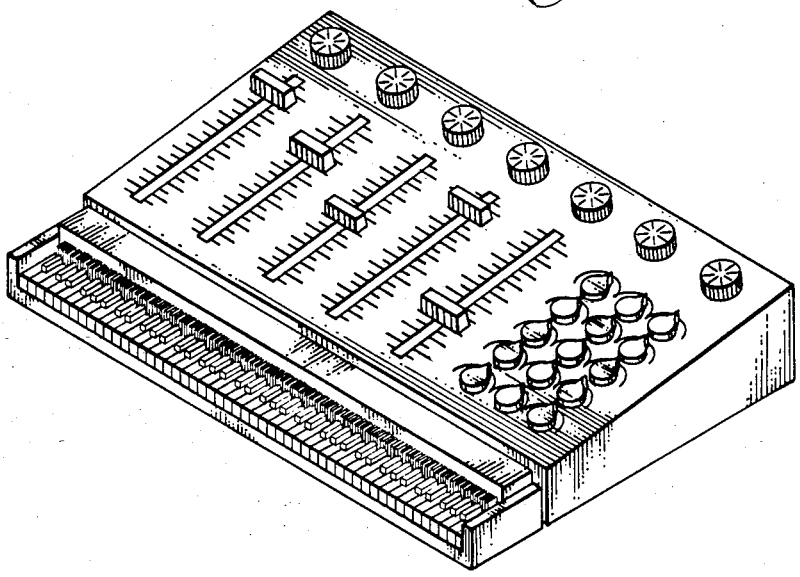
FIG. 5 is a schematic and front elevation view of a synthesizer with the keyboard of FIG. 1.

FIG. 5 shows the modified keyboard as used in conjunction with a typical synthesizer. The keyboard is arranged in the same manner as described with respect to FIGS. 1–3 and the means for producing the desired tone through depression of keys is similar to that described above with respect to the switches. The physical arrangement for accomplishing production of additional pitches beyond that available with basic synthesizers is much simpler than for a piano due to the simpler electronic interface in a synthesizer relative to the mechanical interface in ordinary pianos. For example, depression of a synthesizer key merely activates an electronic circuit (not shown) for producing the desired pitch, whereas in the piano depression of a key activates various levers and other mechanisms for striking the appropriate set of piano wires. In either case, the keyboard is the same so that a student of piano or other keyboard instrument can approach the keyboard and still play the ordinary repertoire without having to learn additional fingerings. To supplement the repertoire, it would be a short step to add the desired fingerings for depressing the narrow keys for producing intermediate tones.

Other keyboard instruments may be modified as appropriate to achieve the same improvement as described herein with respect to pianos and synthesizers. Suitable instruments could be the accordion and the organ.

It should be noted that the above are preferred configurations, but others are foreseeable. The described embodiments of the invention are only considered to be preferred and illustrative of the inventive concepts. The scope of the invention is not to be restricted to such embodiments. Various and numerous other arrangements may be devised by one skilled in the art without departing from the spirit and scope of the invention.

What is claimed is:

1. A keyboard for a musical instrument including at least one series of keys the series of keys comprising:

seven wide keys at a first level each having a substantially flat top surface, each having a width and each coupled to means for producing a sound representing a respective pitch;

five intermediate width keys at a second level raised from the first level each having a substantially flat top surface, each having a width less than the width of a wide key, and each coupled to means for producing a sound representing a respective pitch arranged with respect to the wide keys wherein a first intermediate key is positioned between first and second wide keys, a second intermediate key is positioned between the second and a third wide key, a third intermediate key is positioned between a fourth and a fifth wide keys, a fourth intermediate key is positioned between the fifth and a sixth wide keys, and a fifth intermediate key is positioned between the sixth and a seventh wide keys;

and twelve narrow keys at a third level raised from the second level, each having a substantially flat top surface, each having a width less than the width of an intermediate width key, each having a length equal to the lengths of the other narrow keys and which is less than a length of the intermediate width keys, and each coupled to means for producing a respective pitch and wherein the narrow keys are arranged with respect to the wide and intermediate keys such that a narrow key comprises every other key.

2. The keyboard as claimed in claim 1 wherein each narrow key is recessed into a side of an adjacent key on one side of the narrow key and recessed into a side of an adjacent key on a second side of the narrow key.

3. The keyboard as claimed in claim 1 wherein each narrow key is spaced from each adjacent narrow key such that a finger can depress each narrow key without depressing the adjacent narrow keys.

4. The keyboard as claimed in claim 1 wherein each key comprises a length and wherein the wide keys have a length greater than the length of intermediate keys.

5. The keyboard as claimed in claim 1 wherein each key is adapted to be depressed and wherein each key is depressible an equal distance.

6. The keyboard as claimed in claim 1 wherein the third level is twice a height of the second level.

7. A keyboard for a musical instrument including at least one series of keys the series comprising:

seven wide keys at a first level each having a substantially flat top surface, each having a width and each coupled to means for producing a sound representing a respective pitch;

five intermediate width keys at a second level raised from the first level each having a substantially flat top surface, each having a width less than the width of a wide key, and each coupled to means for producing a sound representing a respective pitch arranged with respect to the wide keys wherein a first intermediate key is positioned between first and second wide keys, a second intermediate key is positioned between the second and a third wide key, a third intermediate key is positioned between a fourth and a fifth wide keys, a fourth intermediate key is positioned between the fifth and a sixth wide keys and a fifth intermediate key is positioned between the sixth and a seventh wide keys; and twelve narrow keys at a third level raised from the second level each having a substantially flat top surface, each having a width less than the width of an intermediate width key, each having a length equal to the lengths of the other narrow keys and which is less than a length of the intermediate width keys, and each coupled to means for producing a sound representing a respective pitch and arranged with respect to the wide and intermediate keys wherein a first narrow key is positioned between the first wide and intermediate keys, a second narrow key is positioned between the first intermediate key and the second wide key, a third narrow key is positioned between the second wide and intermediate keys, a fourth narrow key is positioned between the second intermediate and the third wide keys, a fifth narrow key is positioned between the third and fourth wide keys, a sixth narrow key is positioned between the fourth wide and the third intermediate keys, a seventh narrow key is positioned between the third intermediate key and the fifth wide keys, an eighth narrow key is positioned between the fifth wide and the fourth intermediate keys, a ninth narrow key is positioned between the fourth intermediate and the sixth wide keys, a tenth narrow key is positioned between a sixth wide and a fifth intermediate keys, an eleventh narrow key is positioned between a fifth intermediate and a seventh wide keys and a twelfth narrow key is positioned after the seventh wide keys.

* * * * *